United States Patent [19]

Hurd

[11] 4,032,328

[45] June 28, 1977

[54] METAL REDUCTION PROCESS

[75] Inventor: Frank W. Hurd, Northfield, Minn.

[73] Assignee: University of Minnesota, Inc., Minneapolis, Minn.

[22] Filed: Oct. 23, 1975

[21] Appl. No.: 625,352

[52] U.S. Cl. ..... 75/84.1 R; 75/62; 75/84; 75/84.4; 75/84.5; 266/200

[51] Int. Cl.[2] ..... G22B 5/00; C22B 53/00

[58] Field of Search ..... 75/84, 84.1 R, 84.4, 75/84.5, 62; 266/34 R

[56] References Cited

UNITED STATES PATENTS

| | | | |
|---|---|---|---|
| 3,146,094 | 8/1964 | Hannan et al. | 75/84.5 |
| 3,269,830 | 8/1966 | Sutherland | 75/84.5 |
| 3,801,307 | 4/1974 | Hurd | 75/84.5 |
| 3,839,020 | 10/1974 | Honma et al. | 75/84.5 |
| 3,847,596 | 11/1974 | Holland et al. | 75/84.5 X |
| 3,850,623 | 11/1974 | Sheller | 75/84.4 X |

*Primary Examiner*—Richard E. Schafer
*Attorney, Agent, or Firm*—Jones, Tullar & Copper

[57] ABSTRACT

An improved metal reduction process permits the efficient production of metal from reducible metal compounds by means of reducing metal. Broadly, the invention relates to conducting the reaction between a reducible metal compound and a reducing metal in approximately stoichiometric amounts in an inner beneficial metal container, separated from the exterior reactor walls by an insulating material. In a preferred embodiment, the reducible metal compound and stoichiometric amount of a reducing metal are introduced into a container formed from a metal the same as the desired metal being produced or a metal alloyable therewith. The container is retained in a reaction vessel being separated from the walls of the reaction vessel by an inert insulating material. The container is then heated to a temperature which is above the melting point of the reducing metal but below the temperature at which a reduction reaction between the reducible metal compound and the molten reducing metal will proceed spontaneously. In this temperature range, a reduction reaction is initiated between the reducible metal compound and the molten reducing metal by suddenly disrupting the surface of the molten reducing metal and allowing the reduction reaction to continue to completion. The container in which the reactants have been placed may remain intact or may melt and co-mingle with the product of the reduction reaction.

12 Claims, 3 Drawing Figures

METAL REDUCTION PROCESS

CROSS REFERENCE TO RELATED DISCLOSURE DOCUMENT

Applicant hereby claims the benefits to Disclosure Document No. 024,383 filed Oct. 26, 1973, which is hereby incorporated by reference.

BACKGROUND OF THE INVENTION

In applicant's co-pending application Ser. No. 275,257, now U.S. Pat. No. 3,801,307, the disclosure of which is hereby incorporated by reference, there is disclosed a process for reduction of reducible metal compounds wherein the reducible metal compounds and stoichiometric amount of reducing metal are introduced into a sealed reaction zone and heated to a temperature which is above the melting point of the reducing metal but below the temperature at which a reduction reaction between the reducible metal compound and the molten reducing metal will spontaneously occur. In this temperature range a reduction reaction is initiated between the reducible metal compound and a molten reducing metal by suddenly disrupting the surface of the molten reducing metal and allowing the reduction reaction to continue to completion. This process is a highly advantageous and economical process. However, it has been found especially where relatively large reaction masses are employed the product metal becomes molten from the heat of the reaction and adheres to or alloys with walls of the reaction vessel, which is usually ferrous in nature, thereby sometimes causing undersirable contamination of the product metal. For example, titanium metal attacks iron at a temperature of about 975° C. Since iron is an undesirable contaminant for most purposes, the resultant iron-titanium alloyed is undesirable.

In addition, even when the reactor wall is a metal which does not form an undesirable alloy, for example, the same metal as is being formed, the intense heat of reaction tends to weaken or burn through the reactor wall, where the wall is not protected. U.S. Pat. No. 2,890,111, for example, describes cooling the reaction wall. However, this procedure retards the formation of a coherent fused plaque or button of metal.

The concept of a porous inert insulation layer between the reacting components and the side walls of a reactor has been described in the art, for example, in the preparation of vanadium and other metals by the thermite process (Z. anorg. Chem. 64, 217-24, CA 4, 874, 1910). Insulating layers have also been used for the reduction of uranium and thorium and are described by H. A. Wilhelm et al, *Journal of Chemical Education*, Vol. 37, page 56, February 1960.

SUMMARY OF THE INVENTION

The present invention relates to an improved metal reduction process which permits the efficient production of a metal from its reducible metal compound by reacting substantially all of the metal compound simultaneously with substantially all of the reducing metal in a closed reaction zone without encountering adherence to, alloying with or being contaminated by the walls of the reactor. Broadly, the invention relates to conducting the reaction between a reducible metal compound and a reducing metal in approximately stoichiometric amounts in an inner beneficial metal container, separated from the exterior reactor walls by an insulating material. A beneficial metal is a metal which is the same as the product metal, or which forms a useful alloy with the product metal.

Briefly described, the preferred process of this invention includes the following steps. A reducible metal compound and a reducing metal are introduced into a container within a reaction zone, without any pre-mixing of these reactants, in amounts usually not more than ten percent (10%) excess of either reactant over the stoichiometric requirements for the complete reduction of the metal compound to the zero valence state of the metal. The reactants are confined in a beneficial metal container, that is a metal which is substantially the same as the product metal or which alloys with the product metal to produce useable alloys. This beneficial metal container is then surrounded by a porous insulating or spacing material. After the reaction zone is sealed, the reactants are heated therein without any significant agitation of the reactants from a temperature below the melting point of the reducing metal to a temperature which is above the melting point of the reducing metal, but below the thermal initiation temperature at which the reduction reaction will proceed spontaneously. After the reactants are brought within the foregoing temperature range, a reduction reaction is initiated between reducible metal compounds and the reducing metal by suddenly disrupting the surface of the molten reducing metal, and allowing this reaction to continue spontaneously and exothermally to thereby produce a zero valence state of the reducing metal. Subsequently, the reducing metal is withdrawn from the reaction zone.

In a preferred embodiment, the reducible metal compound and the reducing metal are separated from each other by a septum until the sudden intimate mixing takes place.

In the preferred embodiment, the reactants are maintained at a temperature significantly below the thermal initiation temperature before the reduction reaction is initiated by the sudden disruption of the surface of the molten reducing metal. The thermal initiation temperature in this case is defined as the temperature to which the reactants must be heated at rest in a sealed reaction vessel to cause the reaction to proceed spontaneously without disrupting the surface of the molten reducing metal and then to continue to react to completion without the benefit of externally supplied heat or agitation.

After the reduction reaction is completed, the product, the zero valence state of the reduced metal, is generally substantially separated by the by-product salt and can be easily recovered from the reaction vessel.

A key feature of the present invention is that product metal is obtained without adherence to or contamination by the inner walls of the reaction vessel, also the product is not disseminated into the insulation.

THE DRAWINGS

DETAILED DESCRIPTION THE REDUCIBLE METAL COMPOUND

Figure 1:
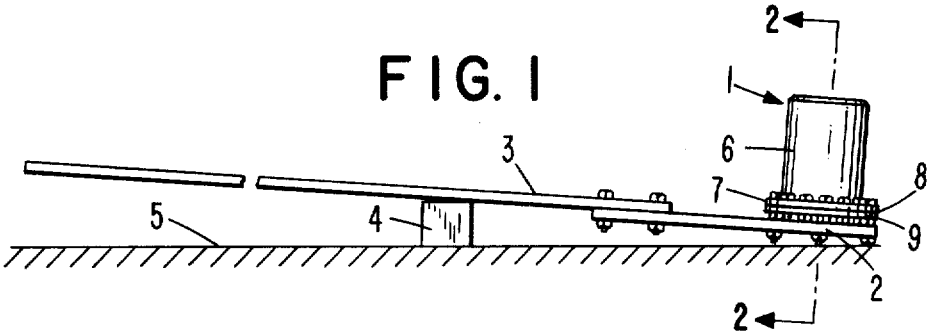
FIG. 1 is a side elevation of an apparatus, including a reaction vessel, which can be used in the practice of this invention on a laboratory scale.

This process of the present invention is applicable to any metal compound which can be reduced with a molten reducing metal. Such reducible compounds include the halides, oxides and sulfides of titanium, zirconium, hafnium, vanadium, niobium, tantalum, silicon, germanium, tin, lead, thorium, uranium, plutonium, boron, beryllium, and the like. Among the various compounds of these metals, the metal salts of the common inorganic acids are preferred. The metal halides are particularly preferred, especially the halides of the metals found in groups IVA, IVB, VA, VB, VIA, and VIB of the Periodic Chart. The halides of metals of groups IIIA, IIIB, and the actinide series can be used to advantage in the present process.

Illustrative reducible metal compounds are $TiCl_4$, $TiBr_4$, $TiF_4$, $ZrCl_4$, $BeCl_2$, $SnCl_4$, $NbCl_5$, $VCl_4$, $TaCl_5$, $UCl_4$, $UF_4$, $UF_6$, $ThCl_4$, $ThF_4$, $PuF_4$, $Fe_2O_3$, $Nb_2O_5$, CoO and $MoS_2$.

Reducible metal compounds of the transition metals are very useful in this invention. Of the transition metals, titanium and zirconium are preferred. The present invention is unusually well suited for the production of titanium from titanium tetrachloride and zirconium from zirconium tetrachloride.

Further, alloys of the various metals discussed above can be produced by the process of the present invention. For example, a titanium-tin alloy can be formed by reacting a reducible metal compound of titanium such as $TiCl_4$, and a reducible metal compound of tin, such as $SnCl_4$, in the presence of a suitable reducing metal, such as sodium, within the conditions of the present method.

The metals which can be used as reducing agents in the present invention include any metal which is capable of reducing the selected reducible metal compound. As is known in the art, metals which will reduce certain compounds will not reduce all compounds. However, the selection of a suitable reducing metal is within the skill of the art once the reducible metal compound is identified or selected.

The reducing metals used in the practice of this invention can be selected from the group consisting of alkali metals, such as lithium, sodium, and potassium; the alkaline earth metals, such as magnesium, barium, and calcium; aluminum; and the rare earth misch metals.

Preferred reducing metals include sodium, magnesium, potassium, lithium, barium, calcium, and mixtures thereof. Sodium, mixtures of sodium with barium, sodium with calcium and sodium with potassium are particularly useful as reducing metals for reducible metal halide compounds, such as $TiCl_4$, $BeCl_2$, $ZrCl_4$, $VCl_4$, $NbCl_5$, $TiBr_4$, $TiF_4$, $UF_6$, $UF_4$, $ThF_4$ and $PuF_4$.

Although aluminum is not a good reducing metal for producing metals from reducible metal halide compounds, it does function satisfactorily as a reducing metal for other reducible metal compounds, such as $Fe_2O_3$, $Cr_2O_3$, $TiO_2$, $ZrO_2$, and mixtures of FeO and $TiO_2$.

Selection of Suitable Reactants

In many instances, the selection of the reducible metal compound is limited by the availability in commercial quantities of reducible compounds of the selected metal. For example, titanium tetrachloride is commercially available or can be prepared from commercially available raw materials. Accordingly, titanium tetrachloride is one primary source of titanium metal.

The selection of a suitable reducing metal is within the skill of the art when aided by this disclosure. Factors to be considered in selecting a reducing metal for use in the process of this invention include the following:

1. the ability of the reducing metal to react with the reducible metal compound under the anticipated conditions of use;
2. the melting point and boiling point of the reducing metal compared to those of the reducible metal compound;
3. the cost and commercial availability of the reducing metal;
4. the relationship between the melting point of the reducing metal and the thermal initiation temperature for the reduction reaction for the selected combination of reducible metal compound and reducing metal, and
5. the type of by-products produced during the reduction process.

As previously indicated, particularly effective combinations of reducible metal compound and reducing metal are in the combination of titanium tetrachloride and sodium metal, and the combination of zirconium tetrachloride and sodium metal.

Relative Amounts of the Reactants

When possible, the relative amounts of reducing metal and reducible metal compound which are used in the practice of this invention should be substantially stoichiometric. Ordinarily, it is not necessary to use any significant excess of either of the reactants, and the use of substantial excesses, for example, over 25% excess of either reactant, should be avoided. Ordinarily, the process of this invention requires less than 10 % excess of either reactant, and desirable less than 5% excess of either reactant. Preferably, less than 1% excess of either reactant is most desirable.

The Temperature

The temperature at which the reaction of the present invention is initiated, by the sudden disruption of the surface of the molten reducing metal, is below the boiling point of the reducing metal and can range from the melting point of the reducing metal up to within about 50° C., or less, of the "thermal initiation temperature" for the reduction reaction.

By "thermal initiation temperature", I mean the temperature to which the reactants must be heated at rest in a sealed reaction vessel to cause the reactants to react spontaneously without disrupting the surface of the molten reducing metal and then to continue to react to completion without the benefit of externally supplied heat or agitation.

By contrast, initiation of the process of the present invention is characteristically induced at temperatures significantly below the thermal initiation temperature. Thus, if one heats the reactants to an initiation temperature as taught herein (i.e. significantly below the thermal initiation temperature), and either does not mechanically initiate the reduction reaction by intentionally disrupting or proliferating the surface and body of the molten metal, or inadequately manipulates the reactants in mechanically initiating the reduction reaction, little or no reaction will occur and the reaction will not proceed to completion.

Desirably, the temperature at which the process of the present invention is initiated will be the minimum required to achieve an acceptable rate of reaction when the surface of the molten reducing metal is sharply disrupted in the presence of the reducible metal compound. In the present invention, the preferred temperature of initiation is more than 100° C. and usually more than 200° C. below the thermal initiation temperature. Frequently, a combination of a reducible metal compound and reducing metal can be selected so that there is a broad temperature range, for example, several hundred centigrade degrees, over which the reaction could be induced or mechanically initiated. However, once initiated, the reducing reaction is exothermic and the temperature will rise above the calculated thermal initiation temperature. With this in mind, it is advantageous in the present invention to select the lowest initiation temperature that meets many or all of the following objectives:

a. the temperature should provide an acceptable rate of reaction when the reaction is initiated;

b. the temperature should be high enough to cause the exothermic temperature reached during the reaction to be sufficient enough to bring the reduced metal above its melting point.

When using magnesium or sodium as the reducing metal, and using titanium tetrachloride as the reducible metal compound, the thermal initiation temperature for the reduction reaction is ordinarily about 600° C. and thermally initiated reduction processes, such as the Kroll process, are typically carried out within the temperature range of from 700–850° C. By contrast, the present process can be carried out at temperatures as low as the melting point of sodium (about 98° C.). A very useful initiation temperature for the present process, using sodium metal as the reducing metal and titanium tetrachloride as the reducible metal compound, is from 120° C.–400° C.

Initiating the Reaction

The reduction process of the present invention is initiated by disrupting the surface of the molten reducing metal after it has been heated to the temperature previously indicated. This can be accomplished by abruptly shaking or jarring the reaction vessel or zone, by rapid agitation of the reactants, or by any other means which produced a sudden material change in the shape or area of the surface of the molten metal which is exposed to or in contact with the titanium tetrachloride.

Disrupting the surface of the molten metal results in a proliferation or dispersion of freshly exposed reducing metal into intimate contact with the reducible metal compound. This disruption or proliferation of the molten metal serves to initiate the reduction reaction in the present invention. Another way of viewing this phenomenon is to consider that the thermal initiation temperature under quiescent conditions, that is the "thermal initiation temperature" of the prior art, is higher than the initiation temperature under conditions wherein molten reducing metal is being dispersed or proliferated as in the present invention.

Although a variety of means can be used to disrupt or proliferate the molten reducing metal, end-to-end agitation, that is agitation in a direction perpendicular to the surface of the molten metal or along the major axis of the container, is much more effective than, for example side-to-side shaking or rotary mixing in vertically oriented cylindrical reaction vessels. Thus, the direction of agitation can be important and should ordinarily be performed in the direction or manner which results in the best or most efficient proliferation of the molten reducing metal. With cylindrical reaction vessels, agitation in the direction of the axis is preferred. For example, end-on-end mixing against the flattended ends of the reaction vessel is particularly beneficial.

Once initiated, heat is produced by the reduction process and desirably the external heat should be removed from the reactor and, if necessary, cooling means should be provided for controlling the temperature within the reaction zone.

Reaction Vessel and Related Equipment

The reaction vessel can take any of a variety of shapes. Apparatus suitable for practicing this invention on a laboratory scale is shown in the drawings.

In FIG. 1, a reaction pot or vessel, generally designated by the numeral 1, is attached to a support arm 2 which is bolted to an extension arm 3. Extension arm 3 extends over a block 4 which serves as fulcrum. Block 4 rests on floor 5.

Reaction vessel 1 comprises a cylindrical body 6, the upper end of which is closed. The open end of cylindrical body 6 is provided with an outwardly extending annular flange 7 which is provided with means, such as bolts, for fastening gasket 8 and cover 9 to cylindrical body 6. Reaction vessel 1 is further adapted for attachment to supporting arm 2.

Figure 2:
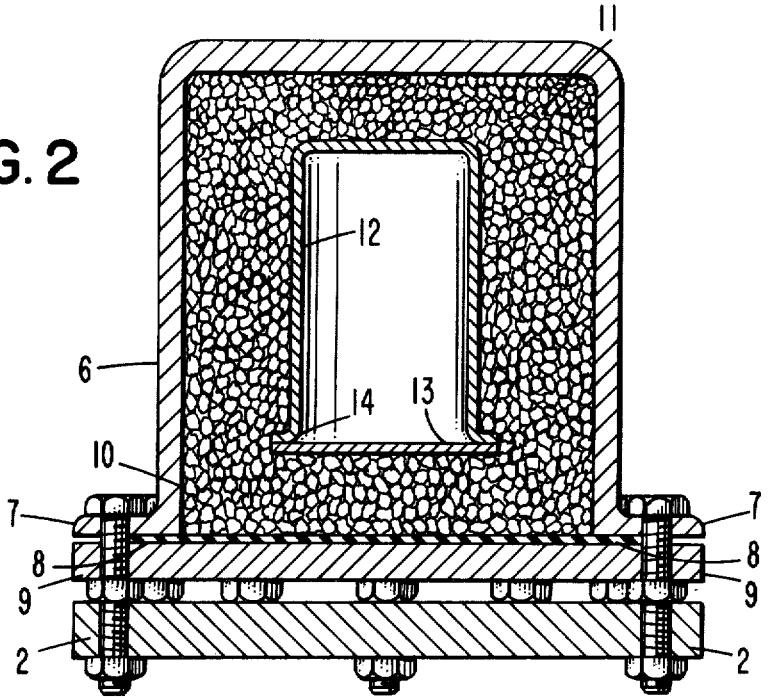
FIG. 2 is a cross-sectional view of the reaction vessel shown in FIG. 1. This view is taken along the lines 2—2 in the direction of the arrows in FIG. 1.
Figure 3:
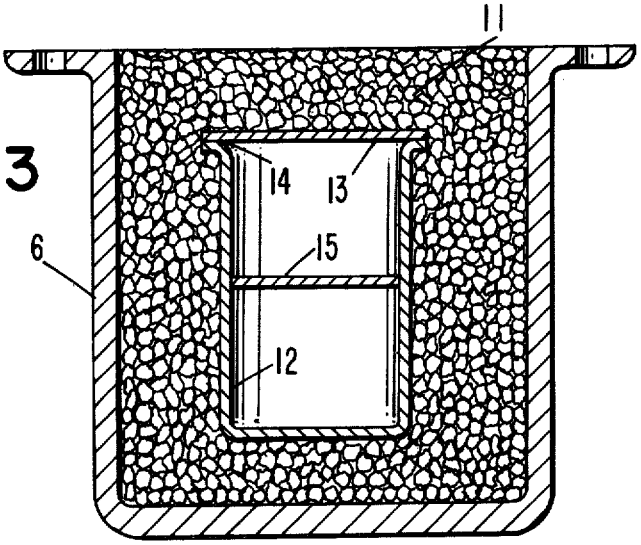
FIG. 3 is a cross-sectional view of the reaction vessel shown in the preceding Figures wherein a septum is employed to separate the reactants. This view is taken along the line 2—2 in the direction of the arrows in FIG. 1.

As shown in FIG. 2, within the reaction vessel 6, there is provided a metal container 12 with a lid 13 which is most preferably hermetically sealed, for example, by heliarc welding around flange 14. This metal container is surrounded by, supported upon and separated from the inside surfaces 10 of the reaction vessel 6 by a layer 11 of relatively inert insulating material.

In operation, the reaction vessel which is shown in FIG. 1 is disassembled and the reaction vessel 6 inverted. The closed base portion of the reaction vessel is covered with a layer of particulate insulating material which is compacted by tamping. A sealed metal cylinder 12 containing the reducing metal and the reducible metal compound in stoichiometric proportions in quantities sufficient to, for example, fill approximately 40–80% of the volume of the cylinder 12. Additional porous insulating material is then tamped around the body of the cylinder 12 and above the cylinder to fill the reaction vessel 6. The reaction vessel is then sealed by attaching the cover 9 to the body 6 with suitable bolts and a copper gasket 8. Reaction vessel 1 is then attached to the support arm 2.

The Insulating Material

The insulating material separates the metal reaction container from the interior wall of the reduction vessel prior to and during reaction as well as to separate the product metal from contact with the interior surface of the reaction vessel while in a molten state may be virtually any inert high melting material. Preferred insulating material is a particulate or granular material which can be compacted to provide a relatively unreactive porous layer which retards the ready contact of the reactants or reaction products with the reactor walls.

In another embodiment, the insulating layer may be formed by the use of a high melting molten material such as a salt, which is cast to the desired shape in molten form and allowed to cool.

The insulating material must be a high melting material so that it will perform as a barrier to prevent molten product metal which contacts it from reaching the interior walls of the reaction vessel. Were the appropriate materials utilized, the high melting insulating material may in fact melt below the peak exotherm temperature of the reduction reaction. In this case, materials such as sodium chloride, for example, will be partially melted, absorbing the heat of reaction and co-mingling with the reaction products. In such a case, the thickness of the layer is chosen so that the heat of reaction is dissipated before a substantial proportion of the insulating layer is melted thus preventing molten product metal from reaching the interior surface of the reaction vessel.

In any event, thickness of the layer of insulating material is dependent on the nature of the reactants, the quantity thereof, as well as the nature of the insulating material itself. The thickness should be sufficient to avoid substantial contact with the product metal with the interior surface of the reaction vessel. The use of a substantial excess of the material is not necessarily deleterious, but would be economically disadvantageous since the amount of heat energy which must be put into the system to heat the reactants to the desired initiation temperature would be substantially increased unnecessarily, or dissipated.

The insulating material should be relatively inert to the reactants of the product metal. However, a material which is not truly totally inert, in a chemical sense, may be employed as the inert insulating material so long as it has a reactivity with the reactants several orders of magnitude smaller than the desired reaction. Since the reduction reaction proceeds with extreme rapidity, only a small portion, if any, of such an insulating material is reacted. Thus the insulating material preforms in effect as a relatively inert insulating material. Further, where an alkali metal or alkaline earth metal salt, for example, a halide or an alkaline earth metal oxide, is employed, even if some interchange between the reducing metal and the alkali or alkaline earth metal ion in the insulating material does occur, the exchanged ion also functions as a reducing metal. Thus, it does not substantially detract from the principal reaction. Thus, where sodium is used as a reducing metal and calcium fluoride is the insulating material, even if a relatively small amount of exchange between sodium and calcium were to take place, the calcium is in effect a reducing metal. Thus, such an exchange would not affect the reaction, yield or cause of contamination of the product metal and thus, for the purposes of this invention calcium fluoride would be considered an inert insulating material.

A highly satisfactory insulating material is calcium fluoride. However, a high melting alkali metal or alkaline earth metal compound, such as a halide or oxide, may be employed. Other insulating materials include $ZrO_2$, cermet, electrically fused dolomite oxide, or finely divided metal especially when the metal is the same as at least one of the metals formed in the reduction reaction.

Metal Reactant Container

The metal reacting container into which the reactants are placed and in which the reduction reaction is initiated can be formed from the metal or an alloy of the metal which is the product metal of the reduction reaction. The metal reacting container may also be formed from any metal alloyable with the product metal. The choice of the desired product metal or the end use of the product metal will govern to some extent the choice of the metal container employed. For example, where titanium is produced, the metal container may be aluminum, as aluminum is a metal frequently alloyed with titanium.

The deliberate choice of the metal container is frequently highly desirable and multiple component alloys can be achieved. For example, where a mixture of titanium tetrachloride and vanadium tetrachloride are reduced with, for example sodium in an aluminum container, alloys such as Ti, 6% Al, 4% V, can be achieved. Ti, 5% Mo, 2.5% Sn can be formed using a molybdenum can and reducing $TiCl_4$ and $SnCl_4$. To form zircalloy (containing a little tin), $ZrCl_4$ and $SnCl_4$ can be reduced in a zirconium lined container utilizing $CaF_2$ as insulation.

Where pure metals are desired, the metal container is the same as the metal container in the reducible metal compound.

The exact physical nature of the metal container is subject to wide variation while it is hereinabove described as a cylinder it need not be, and in fact, can be spheroidal, rectangular or nay other shape, although the use of a cylinder is highly preferred.

The thickness of the inner container is also subject to wide variation. It may be a metal foil or a container of substantial thickness. The means for providing a closed container are not critical and closure may be obtained by the use of a welding, a threaded cap, fasteners, such as nuts and bolts, crimping, adhesives or any other suitable closure means.

The Operaton of the Invention

It is highly preferred that the reduction reaction take place in the absence of oxygen, nitrogen, carbon dioxide or moisture. Thus, one skilled in the art would recognize that the reactants are preferably charged in a metal container and the container charged into the reaction vessel in such a manner as to exclude substantial amounts of reactive gases. This can be accomplished by operating under and/or flushing the system with an inert gas such as helium or argon.

To initiate the reaction, the reactants, inner metal container and insulating material, having been charged into the reaction vessel, are heated to the desired temperature. This heating can be accomplished by various means including the use of a heating mantle encircling body of reaction vessel 1 and/or by means of the heater placed between 4–5 and supporting arm 2 immediately below the reaction vessel 1 or in oil or by steam or sodium jacket. After the desired temperature has been obtained, heating is discontinued.

Next the reduction reaction is initiated by quickly or sharply disrupting the surface of the molten metal within the metal container 12. Although various means can be used to accomplish this purpose, a convenient laboratory method is to suddenly depress or rotate extension arm 3 about the fulcrum 4 one or more times in rapid succession to provide sharp vertical agitation.

While not wishing to be bound by any theory, it has been observed, in the case of titanium tetrachloride, that a coating forms on the surface of the molten metal which is in contact wth the reducible metal compound and it is believed that this coating or surface layer inhibits the reduction reaction until either the temperature is raised high enough to thermally initiate the reaction, for example, by causing the molten metal to vaporize or until the surface of the molten metal is sharply disrupted to thereby expose fresh molten metal. By initiating the reaction in the latter manner, such as by mechanically disrupting the surface of the molten metal, te reaction can be started at a lower temperature and the enormous pressures associated with the prior art processes can be avoided. In the case of reducible compounds of polyvalent metals, this may be the result of a shift in the reaction mechanism and/or the reaction kinetics.

For example, once the reaction between titanium tetrachloride and sodium is initiated by disrupting or proliferating the surface of the molten sodium, the reaction proceeds spontaneously. The reaction is exothermic and is independent of vessel size. The reduction reaction can be allowed to proceed without external heat or without external cooling means. After the reduction is completed, the reaction vessel and its contents can be permitted to cool at room temperature. The reaction vessel 1 is then detached from support arm 2 and cover 9 is removed. If, in fact, the amount of reactants is small enough and the reacting inner container is of sufficient thickness, the reaction products will be found within the reaction container. Generally, the reaction product will be a disc or plaque of the reduced metal. Above this will be a salt deposit. The top and sides of the inner container will be covered with a thin layer material which may be salt excess, the reducing metal and/or small particles of the reducing metal adhering to the reactor walls.

Usually, however, due to the exotherm of the reduction reaction, the inner metal container will become melted resulting in a substantially coherent biscuit of metal or metal alloy where the bottom of the reaction container had been. Veins of residual metal derived from the container and/or reduction metal will have penetrated the insulating material but preferably none of these veins have reached the inner wall of the outer container. To a large extent the product metal will be separated from the salt formed in the reduction reaction.

One benefit of the process of this invention is that, even though the inner container may be melted during the course of the reaction, generally less product metal will have penetrated into the insulating material than if the container were not present. Also, since penetration of the insulating material is lessened, the necessity of packing the insulating material with great care is somewhat lessened. In addition, the insulation material no matter how carefully prepared may contain at least a small amount of moisture which is released at the reaction temperature. The inner container retards the moisture from reacting with the reducing metal or from readily forming product metal oxide.

The present invention is further illustrated by the following specific examples which evidence the applicability of the present invention to reducible metal compounds of titanium, zirconium, hafnium, uranium, vanadium, niobium, thorium, beryllium, and molybdenum. As can be seen from the following examples, the process of the present invention is particularly useful in the production of titanium, zirconium, hafnium, uranium, vanadium, niobium and thorium from reducible halide compounds of these metals.

In the following examples and throughout the specification all parts and percentages are by weight unless otherwise specified.

EXAMPLE 1

A cylindrical aluminum can 4 inches in diameter and 6 inches tall was charged with 313 grams of sodium and 370 mm. of titanium tetrachloride, this charging being done under an argon atmosphere. A lid was heliarc welded to the top of the can and the can loaded into a cylindrical 6 inch i.d. steel reactor 8 inches deep. Ignited calcium fluoride (−200 mesh) was packed around the aluminum can on all sides. The reactor was heated in a paraffin bath to a temperature of over 230° C. during an interval of 2 hours. Initiation of the reaction was then accomplished by agitation, as shown in FIG. 1, by rapidly moving the extension board three times, each giving a vertical travel to the reactor of 4.7 inches. After the reaction subsided, the reactor was opened. A coherent button of titanium-aluminum alloy weighing 298 grams was recovered. Little, if any titanium tetrachloride and sodium escaped into the surrounding calcium fluoride powder.

EXAMPLE 2

In a like manner, in accordance with the examples of U.S. Pat. No. 3,801,307, as modified, the same manner described in Example 1, above, using an aluminum can, the following reduction reactions may be accomplished in the manner described in Example 1. The reduction of titanium tetrachloride using a mixture of sodium and barium as a reducing metal, an alloy of titanium and tin from a mixture of tin tetrachloride and titanium tetrachloride using sodium as a reducing metal, the reduction of titanium tetrabromide using sodium as a reducing metal; the reduction of titanium tetrafluoride using sodium as a reducing metal, the reduction of zirconium tetrachloride using sodium as a reducing metal in the production of zirconium tetrachloride using a mixture of sodium and calcium as a reducing metal, the reduction of vanadium tetrachloride using sodium as a reducing metal, the reduction of niobium pentachloride using sodium as a reducing metal; the reduction of beryllium dichloride using sodium as a reducing metal; the reduction of molybdenum sulfide using lithium as a reducing metal; the reduction of hafnium tetrachloride with sodium as a reducing metal; the reduction of uranium hexafluoride with sodium as a reducing metal; the reduction of thorium tetrachloride with sodium as a reducing metal.

EXAMPLE 3

In a like manner all the reactions described in Examples 1 and 2, above, may be conducted in an inner container formed from the same metal as the product metal. One particularly useful reaction is the reduction of $UF_4$ with magnesium using a thin layer of uranium metal as the inner liner and employing electrically fused dolomitic oxide as the insulating material.

Reducible metal compounds other than reducible metal halides may be used as a source of the metal to be recovered. For example, Example 13 of U.S. Pat. No. 3,801,307 demonstrates the reduction of molybdenum sulfide with lithium, according to the procedure of the present invention, will be operative. Further, British Pat. Nos. 729,503 and 729,504 indicate that $TiO_2$, $Li_2TiO_3$, $V_2O_5$, $Cb_2O_5$, $Ta_2O_5$, $Cr_2O_3$, $MoO_3$, $wO_3$, MnTe, FeS, and $U_3O_8$ may be reduced to form their respective metals.

Though the present invention has been illustrated above in a number of specific examples, the procedure of this invention may obviously be applied to reducible metal compounds not specifically mentioned above in view of the broader aspects of this procedure.

What is claimed is:

1. A reduction process for the production of a product metal, which includes the step of reacting a reducible metal compound and a reducing metal in a sealed preformed beneficial metal container contained in a sealed outer reaction vessel and spaced from and insulated from the walls of said reaction vessel by means of a relatively inert insulating material, said beneficial metal container comprising the product metal or a metal which forms a useful alloy with said product metal.

2. A reduction process for the production of a product metal, as in claim 1, which process includes the steps of:

a. placing a reducible metal compound of the product metal and a reducing metal capable of reducing said reducible metal compound in a metal container, said metal container comprising the product metal or a metal which is alloyable with said product metal;

b. sealing said metal container containing the reactants in a reaction vessel, the metal container being spaced from the walls of said reaction vessel by means of a relatively inert insulating material;

c. heating the reactants without any substantial agitation from a temperature below the melting point of the reducing metal to a temperature which is both above the melting point of the reducing metal and below the temperature at which a reduction reaction between the metal compound and the reducing metal will proceed spontaneously;

d. initiating a reduction reaction between the reducible metal compound and the molten reducing metal by causing the surface of the molten reducing metal to be suddenly disrupted;

e. permitting the reduction reaction to continue to thereby produce a reduced metal in a zero-valence state; and f. thereafter removing said reduced metal from the reaction zone.

3. The process of claim 2 in which the reducible metal compound is a reducible compound of a metal selected from the group consisting of titanium, zirconium, hafnium, uranium, vanadium, niobium, thorium, beryllium, molybdenum, and mixtures thereof.

4. The process of claim 3 in which the reducible metal compound is a reducible halide compound of a metal selected from the group consisting of titanium, beryllium, zirconium, hafnium, uranium, vanadium, niobium and thorium.

5. The process of claim 4 in which the reducible metal compound is titanium tetrachloride.

6. The process of claim 4 in which the reducible metal compound is zirconium tetrachloride.

7. The process of claim 3 in which the reducing metal is selected from the group consisting of sodium, potassium, calcium, barium, magnesium, lithium, and mixtures thereof.

8. The process of claim 7 in which the reducing metal is selected from the group consisting of sodium, potassium, sodium mixed with barium, and sodium mixed with calcium.

9. A process such as in claim 2 wherein the relatively inert insulating material is selected from the group consisting of high melting alkaline earth metal and alkali metal halides and oxides.

10. A method as in claim 9 wherein the insulating material is selected from a group consisting of calcium fluoride, calcium oxide, magnesium oxide and dolomite lime.

11. A method as in claim 2 wherein the metal container comprises a container formed from the product metal.

12. A method as in claim 2 wherein a metal container is formed from aluminum.

* * * * *